US006484816B1

(12) United States Patent
Koederitz

(10) Patent No.: US 6,484,816 B1
(45) Date of Patent: Nov. 26, 2002

(54) METHOD AND SYSTEM FOR CONTROLLING WELL BORE PRESSURE

(75) Inventor: William L. Koederitz, Cedar Park, TX (US)

(73) Assignee: Martin-Decker Totco, Inc., Cedar Park, TX (US)

( * ) Notice: Subject to any disclaimer, the term of this patent is extended or adjusted under 35 U.S.C. 154(b) by 58 days.

(21) Appl. No.: 09/770,594

(22) Filed: Jan. 26, 2001

(51) Int. Cl.[7] ..... E21B 44/00; E21B 21/08

(52) U.S. Cl. ..... 175/25; 175/38; 175/48; 175/66

(58) Field of Search ..... 175/24, 25, 38, 175/48, 66

(56) References Cited

U.S. PATENT DOCUMENTS 3,552,502 A * 1/1971 Wilson, Sr. ..... 175/218
3,693,732 A * 9/1972 Sabi ..... 166/91.1
3,827,511 A * 8/1974 Jones ..... 166/91.1
5,154,078 A * 10/1992 Codazzi ..... 175/48

* cited by examiner

*Primary Examiner*—David Bagnell
*Assistant Examiner*—Brian Halford
(74) *Attorney, Agent, or Firm*—Browning Bushman, P.C.

(57) ABSTRACT

Methods and systems are provided for maintaining fluid pressure control of a well bore 30 drilled through a subterranean formation using a drilling rig 25 and a drill string 50, whereby a kick may be circulated out of the well bore and/or a kill fluid may be circulated into the well bore, at a kill rate that may be varied. A programmable controller 100 may be included to control execution of a circulation/kill procedure whereby a mud pump 90 and/or a well bore choke 70 may be regulated by the controller. One or more sensors may be interconnected with the controller to sense well bore pressure conditions and/or pumping conditions. Statistical process control techniques may also be employed to enhance process control by the controller. The controller 100 may further execute routine determinations of circulating kill pressures at selected kill rates. The controller may control components utilized in the circulation/kill procedure so as to maintain a substantially constant bottom hole pressure on the formation while executing the circulation/kill procedure.

20 Claims, 1 Drawing Sheet

METHOD AND SYSTEM FOR CONTROLLING WELL BORE PRESSURE

FIELD OF THE INVENTION

The present invention relates to drilling subterranean well bores of the type commonly used for oil or gas wells. More particularly, this invention relates to an improved method and system for regaining hydrostatic fluid pressure control of a well bore after the well bore receives an influx of fluid from the formation. The methods and system of this invention may facilitate more timely circulation of the fluid influx out of the wellbore while circulating a more dense fluid into the well bore to regain hydrostatic control of the well bore.

BACKGROUND OF THE INVENTION

Drilling subterranean wells typically includes circulating a drilling fluid ("mud") through a drilling fluid circulation system ("system"). The circulation system may include a drilling rig and mud treating equipment located substantially at the surface. The drilling fluid may be pumped by a mud pump through the interior passage of a drill string, through a drill bit and back to the surface of the well bore through the annulus between the well bore and the drill pipe.

A primary function of drilling mud is to maintain hydrostatic fluid pressure control of fluids in the formations penetrated by the well bore. Weighting agents may be added to a mud to achieve the desired mud density. Traditional overbalanced drilling techniques typically practice maintaining a hydrostatic fluid pressure on the formation equal to or slightly overbalanced with respect to formation fluid pressure ("pore pressure"), both when circulating and when not circulating the mud. In underbalanced drilling techniques, hydrostatic pressure in the well bore is maintained at least slightly lower than formation pore pressure by the mud, supplemented with surface well control equipment. If the wellbore encounters a zone having a higher pore pressure than the hydrostatic fluid pressure in the mud, an influx of formation fluid may be introduced into the wellbore. Such occurrence is known as taking a "kick."

In the well bore drilling industry, it is common practice to frequently during the course of drilling the wellbore, measure and record slow mud pump rates and corresponding pump circulation pressures required to circulate the mud at the reduced rate with the mud pumps. Such measurements may be made at such rates as may be used in circulating a kick out of the well bore, e.g., one-half to one-third of the normal circulation rate. Additional determinations may also be performed, including the cumulative number of pump strokes required to circulate the hole.

When a kick is taken, the invading formation liquid and/or gas may "cut" the density of the drilling fluid in the well bore annulus, such that as more formation fluid enters the wellbore, hydrostatic control of the wellbore may be lost. Such occurrence may be noted at the drilling rig in the form of a change in pressure in the wellbore annulus, changes in mud density, and/or a gain in drilling fluid volume in the mud system tanks ("pit volume").

Typically when a kick is detected or suspected, mud circulation is halted and the well bore closed in/shut in to measure the pressure buildup in the well bore annulus, pit gain and shut-in drill pipe pressure. Appropriate well-killing calculations may also be performed while the well is closed in. Thereafter, a known well killing procedure may be followed to circulate the kick out of the well bore, circulate an appropriately weighed mud ("kill mud") into the well bore, and ensure that well control has been safely regained.

One of the most common techniques for killing the well and circulating an appropriate kill fluid is the "constant bottom hole pressure" method, whereby bottom hole pressure may be maintained substantially at or above formation pore pressure. Two variations of this method exist. The first variation may be known commonly as the "Driller's method." The Driller's method may be utilized when kill weight fluid is not yet available for circulation. In the Driller's method, the original mud weight may be used to circulate the contaminating fluids from the well bore. Thereafter, kill weight mud ("KWM") may be circulated into the drill pipe and the well bore. Although two circulations may be required to effectuate the driller's method, the driller's method variation may be quicker than the subsequently discussed variation.

The second variation of the Constant Drill Pipe Pressure method may be commonly known as the "wait and weight" method, or the "Engineer's" method. In the "wait and weight" method, KWM is prepared and then circulated down the drill string and into the well bore to remove the contaminating fluids from the well bore and to kill the well, in one circulation. This method may be preferable in that this method may maintain the lowest casing pressure during circulating the kick from the well bore and may thereby minimize the risk of damaging the casing or fracturing the formation and creating an underground blowout.

A substantially constant bottom hole pressure may be maintained in both methods. In either method, pressure on the casing and/or drill pipe may be controlled by adjusting a choke conducting mud from the casing to a mud reservoir. In addition, to further control pressure the mud pump rate may be maintained at one of the previously measured rates and corresponding pressures. In the Driller's method, a constant drill pipe pressure may be maintained during the first circulation, which may include the shut-in drill pipe pressure ("SIDPP") plus the slow rate pump pressure, plus a nominal safety factor, e.g., fifty psig. During the second circulation, the casing pressure may be held constant while the KWM is circulated to the bit, and then the drill pipe pressure held constant while the KWM is circulated from the bit to the surface.

In the "wait and weight" method, a substantially constant bottom hole pressure may be maintained during the one circulation of KWM. KWM may be circulated down the drill string while maintaining drill pipe pressure at a calculated, pre-determined pressure schedule while the mud pump is maintained at a constant rate. The drill pipe pressure may gradually decrease as KWM is circulated to the bit. After KWM reaches the bit, the drill pipe pressure may be held constant until the KWM reaches the surface.

A combination method is known which may combine portions of each of the above two methods. After the well is shut-in and the pressures recorded, pumping of original weight mud may begin while the original weight mud is being weighted up to KWM, as the kick is being pumped out of the well bore.

Each of the aforementioned methods may be time consuming and may require extensive planning, calculations, monitoring, human intervention and/or coordinated regulation of components, rates and pressures during execution of the respective method. In addition, each method typically uses a substantially constant pump rate in order to maintain control of the process during execution of the respective method. The wait and weight method also may require constructing a graphical or tabular pumping schedule of pump pressure versus volume pumped, to follow during the procedure. Further, in the event it becomes necessary to change pumping rates and/or interrupt pumping during execution of the kill procedure, it frequently may be necessary to record new shut-in pressures, new circulating pressures, and recalculate a new pumping and/or pressure schedule. A key component of each method may be adhering to a substantially constant pump rate during the procedure and maintaining a substantially constant bottom hole pressure.

Typically, the intent of the operator is to hold pump rate constant, and only change the pump rate after circulation has started if some excessive or undesirable condition arises. For example, when a circulated kick enters long, narrow, and/or restrictive choke lines, such as may be encountered with a deepwater floating rig. In anticipation of this, the operator may collect slow circulation data at up to three discrete rates.

Following completion of the kill procedure, new pressure readings should be taken, wherein the well may be under hydrostatic control, such that the casing pressure may read substantially zero psig. In the event the shut-in casing pressure and/or drill pipe pressure may not be zero psig, it may be necessary to repeat the kill procedure. A kill procedure may be deficient at completely regaining well control due to inaccurate previous pressure readings, changes in pumping rate during execution resulting in an influx of additional contaminating fluids, and/or otherwise failing to maintain a substantially constant bottom hole pressure in excess of formation pore pressure. A failure to maintain a constant bottom hole pressure may result from miscommunication, erroneous operation of the choke, procedural miscalculations, and/or other inappropriate equipment operation during the procedure.

The amount of human intervention required, including the substantial gathering of rate and pressure information, calculating and scheduling a kill procedure, maintaining a constant pump rate, and coordinating the operation of equipment to maintain the appropriate surface pressures and constant bottom hole pressure are each disadvantages of the prior art.

An improved method is desired for conducting a well killing procedure in a more timely fashion and with greater precision and efficiency than may be possible under existing methods. A method is also desired which may provide for varying the pump rate during the kill procedure without having to shut down and determine a revised pressure and rate pumping schedule.

The disadvantages of prior art are overcome by the present invention. An improved method and system for more accurately controlling well bore hydrostatic pressure are described herein.

SUMMARY OF THE INVENTION

This invention has particular utility in controlling hydrostatic and formation pressures within a well bore. More particularly, this invention may facilitate improvements over prior art in facilitating regaining hydrostatic control of the well bore in a more timely fashion and with improved process control therein. This invention provides methods and systems for circulating a kick out of a well bore and regaining hydrostatic control of the well bore with the ability to vary the pump rate. Thereby, a kick may be circulated from within the well bore and KWM circulated, both in a more timely fashion and with improved process control, as compared to prior art.

A control system may be provided which may monitor and/or record one or more selected drilling parameters and which may also provide automated control of a kill procedure. During drilling the well bore, on a regularly scheduled basis, such as each day, or each crew change, or each particular footage drilled, the control system may obtain and record information pertaining to selected drilling parameters which may be useful in executing a well killing procedure. The control system may record selected pressures, pump rates, and pit volumes in the mud system. Thereby, when a kick is taken, the control system may be relied upon to effectively determine the procedure for circulating the kick from the hole and for circulating the KWM, and then to controllably execute the procedure.

In addition, the control system may facilitate selectively modifying the kill procedure in response to changes or interruptions in the pumping schedule. Thereby, the pump rate utilized during execution of the kill procedure may be selectively varied and/or interrupted while maintaining a substantially constant bottom hole pressure, at or above the formation pore pressure.

It is an object of this invention to provide methods and systems for regaining hydrostatic control of a well bore subsequent to taking a kick, by pumping at a variable pump rate.

It is a feature of this invention to provide methods and systems for regaining hydrostatic control of a well bore subsequent to taking a kick by closing in the well bore annulus with a BOP and a choke on a return fluid flow line, and use a programmable controller to operate at least the choke to maintain a substantially constant bottom hole pressure within the well bore while pumping a kill fluid.

It is a feature of this invention to routinely at selected intervals, automatically measure and record drill pipe circulation pressure for a range of mud pump circulation rates.

It is also a feature of this invention to thereby determine the appropriate drill pipe circulation pressure required to maintain a substantially constant bottom hole pressure, at any point in the kill procedure and at any circulation rate which may be in effect at the time.

It is a feature of this invention to selectively use any of a wide continuum of circulation rates while circulating a kick out of the wellbore, and to vary the rate as desired while pumping the kick out. Selection of pump rate may be made manually by an operator, or automatically by a control system, or both.

It is an advantage of this invention to utilize a control system and sensed measurements of one or more drilling parameters to monitor, control and execute the kill procedure.

It is also an advantage of this invention to expedite circulating a kick out of a well bore, thereby decreasing the time required to regain well control and decreasing well bore drilling costs.

It is further an advantage of this invention to improve control of operable equipment during the procedure by utilizing a control system to regulate pump rates and choke position.

Yet another advantage of this invention is to decrease the potential for creating too much hydrostatic pressure in the well bore and fracturing the formation.

It is an additional advantage of this invention to improve the safety of circulating a kick from a well bore and killing the well, by utilizing a programmable control system. The control system may consider sensed measurements of well bore and drill string pressures, circulation rates, mud weight, well bore dimensions, and thereby determine an optimum kill procedure and thereafter controllably execute the procedure with reduced potential for miscalculation or manual control errors.

These and further objects, features, and advantages of the present invention will become apparent from the following detailed description, wherein reference is made to figure in the accompanying drawing.

DETAILED DESCRIPTION OF PREFERRED EMBODIMENTS

Figure 1:
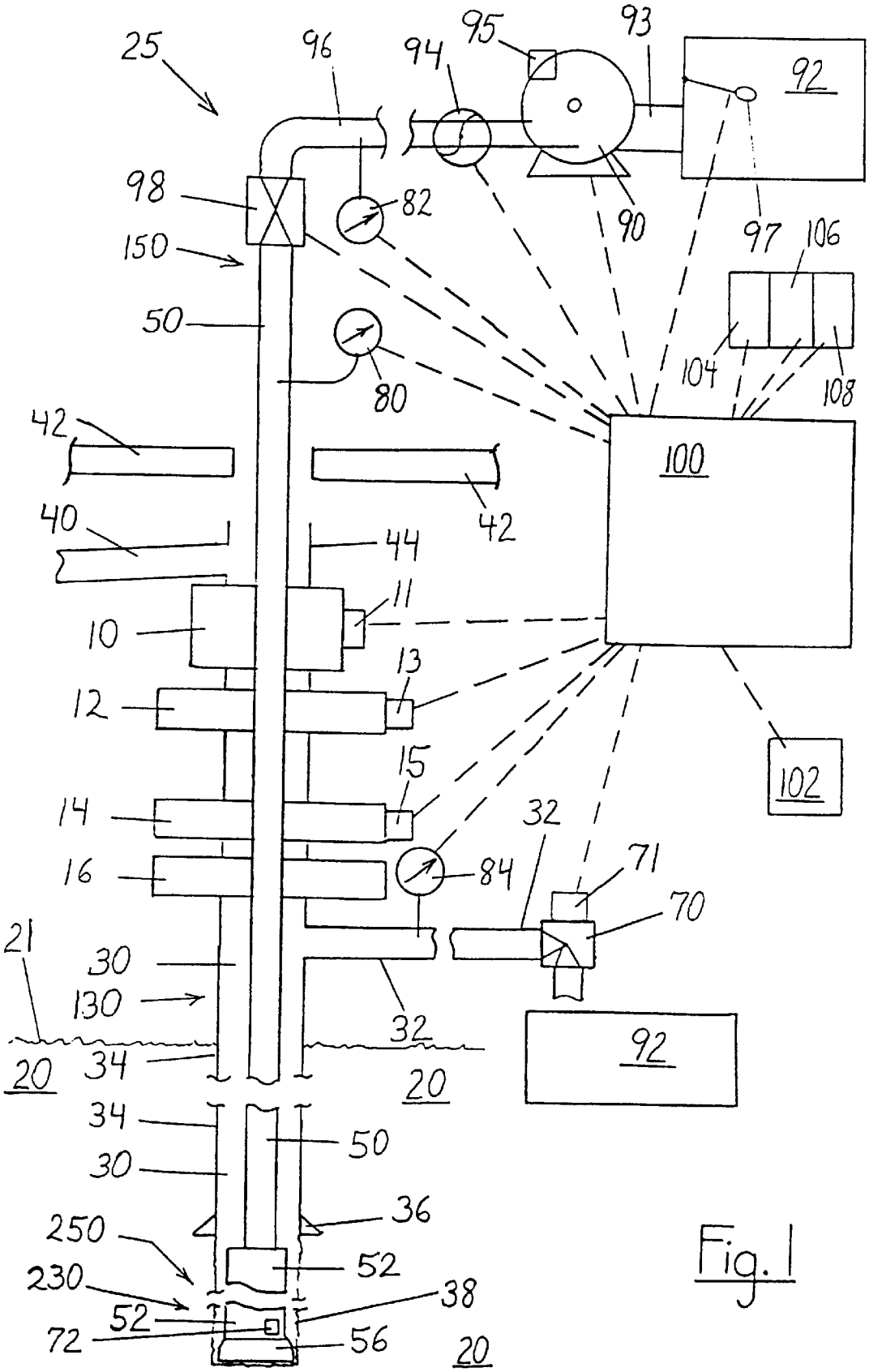
FIG. 1 is a conceptual diagram of a suitable system for circulating a kick out of a well bore and killing the well according to the present invention, including a programmable controller and some optional sensors and regulators.

FIG. 1 illustrates components that may be included in a system for practicing the present invention. A suitable system may include a drilling rig 25 including a rig structure 42 and a drill string 50 at least partially supported by and extending from the drilling rig 25 through an earthen surface 21 substantially adjacent the rig 25. An upper end of the drill string 150 may extend above the earthen surface 21 and a lower end of the drill string 250 may extend through the earthen surface 21 and at least partially into a well bore 30 penetrating one or more subterranean formations 20. The drill string 50 may include a through bore to conduct a drilling fluid ("mud") through the drill string 50. The drill string 50 may comprise a series of interconnected joints of drill pipe. The lower end of the drill string 250 may include a set of drill collars 52 and a drill bit 56.

When drilling, the drill bit 56 and at least a portion of the drill collars 52 and the lower end of the drill string 250 may extend into an open hole section 38 of the well bore 30, substantially within a lower portion of the well bore 230. An upper portion of the well bore 130 may include a casing string 34 cementedly secured within the well bore 30. A lower end of the casing string 34 may include a casing shoe 36, near an upper end of the open hole section 38 of the well bore 30. The cased section of the well bore and the open hole section 38 of the well bore 30 may substantially comprise an interior chamber substantially within the formation 20.

Drilling fluid may be treated and/or stored in one or more mud tanks 92, which may provide drilling fluid to one or more mud pumps 90, through mud pump suction line 93. A mud pump 90 located near the drilling rig 25 may pump drilling fluid through a mud line 96, then into the upper end of the drill string 150, then through a drill pipe valve 98, then through the drill string 50, and then through the drill bit 56. The drilling fluid may then exit the drill bit 56 and circulate from the lower end of the well bore 230 through a well bore annulus between an OD of the drill string 50 and an ID of the well bore 30 to the upper end of the well bore 130. The drilling fluid may then exit the well bore selectively through either a mud return line 40 or a choke line 32, and then flow into a mud treating system 92. A bell nipple 44 may be provided to direct the returning drilling fluids from the annulus to the mud return line 40 and then to the mud treating system 92.

One or more of an annular blow out preventer 10, pipe rams 14 and 16, and/or blind rams may be provided near an upper end of the well bore 130 to selectively enclose the upper end of the well bore 30. A selectively adjustable restriction device may be provided on the choke line 32, such as a valve or choke 70, to at least partially enclose the well bore 30. It will be understood by those skilled in the art that the choke 70 is being used herein to illustrate flow control principles, and in actual practice, an arrangement of several devices may be provided and controlled. For example, a choke manifold assembly and/or a kill line assembly may be provided in fluid communication with the well bore 30.

The lower end of the drill string 250 may also include a measurement device 72, which may sense one or more drilling parameters, such as hydrostatic pressure in the well bore 30, record and/or transmit a signal representative of the measured parameters back to the drilling rig 25. The measurement device 72 may also be a measurement while drilling ("MWD") device, which may sense a plurality of additional drilling parameters, such as fluid pressure within the drill string, and drill bit 56 location relative to the drilling rig 25. Information indicative of hydrostatic pressure within the well bore may be useful in determining the density of the drilling mud.

A programmable system controller 100 and one or more sensors 80, 82, 84, and 95 may be included to sense and/or receive information pertaining to one or more well bore and/or drilling parameters, and to control operation of one or more components utilized in practicing the methods of this invention. The methods and systems of this invention may facilitate timely detection and correction of potential hydrostatic pressure concerns which may be encountered within a well bore. The system controller 100 may be electronically interconnected with one or more sensors that may input information to the controller 100 relevant to the one or more sensed well bore and/or drilling parameters, including well bore conditions. Those skilled in the art will appreciate that, although reference herein is made to well bore and/or drilling parameters, this invention pertains not only to the well bore drilling operations, but may also pertain to operations other than drilling. For example, such parameters may be sensed or monitored when performing well bore related operations such as well completion work or remedial well work. Parameters which may be sensed and input to the controller 100 may include mud tank 92 volume/level, mud pump rate and/or stroke counter, fluid pressure in the mud system and the drill string 50, well bore pressure near the surface, and/or the positions of the choke 70 and the blowout preventers 10, 12, 14, 15. A stroke counter 95 may be included to count pump strokes by the mud pump 90.

Sensors may be included and interconnected with the controller 100 to sense for warning signs of kicks, blowouts, lost circulation and/or potential drilling problems which may be related to hydrostatic pressure control concerns. A pit volume totalizer 97 may be included to monitor or sense drilling fluid volume gains and/or losses in mud tanks 92. A drilling rig 25 may include a plurality of mud tanks 92. The control system 100 may include a densometer and/or a gas sensor to measure mud density and to sense gas cut mud in the mud returned from the well bore 30. The mud return line may include a flow or other flow sensor which may sense lost circulation problems, or a flow rate increase. A drill string weight indicator may be interconnected with the drill string 50 to sense changes in drill string weight. A sensor may be included on a geolograph to sense a drilling break. Operators 11, 15 and 71 are depicted in FIG. 1 for controlling the well preventers and choke.

The control system 100 also may be interconnected with one or more various sensors and/or regulators that may be utilized by the control system in controlling mud circulation and/or pressure control. The sensors 80, 82, 84, 94, 95 may provide one or more signals to the control system 100, which may be utilized by the control system 100 to manipulate one or more regulators to control one or more components. For example, such controlled components may include a mud pump 90, one or more blowout preventers 10, 12, 14, 16, and the choke 70.

Sensing may include sensing, measuring, recording, detecting and/or analyzing. Each sensor 80, 82, 84, 94, 95 may include a redundant sensor at each respective sensed position, such that each sensing act is performed by two or more sensors at each location. Thereby, sensed information from each sensor at a respective position may be compared to the other sensed information at that respective position to determine the accuracy, variance, and/or reliability of the sensed value. Statistical process control techniques may also be used to make this comparison. Such sensor configurations and techniques may increase the reliability of information utilized in controlling a circulation and/or well killing operation. The comparison may be performed by a programmable controller 100 or by an operator. If a discrepancy of sufficient magnitude is detected between the redundant sensors, the controller or operator may make a determination as to which information value to accept or to interrupt operations until an accurate information value can be determined. The protocol for making such determination may be dependant upon the location of the sensor, the type sensor, criticality of the information, and a comparison of the sensed information in context with the particular operation engaged in and contrasted with other information.

A method for regaining and/or maintaining fluid pressure control of a well bore drilled through a subterranean formation according to this invention may be utilized in killing a well, circulating out a kick and/or circulating drilling fluids into a well bore. A method according to this invention may comprise utilizing a programmable controller 100 and a selected array of sensors and/or regulators interconnected with the controller 100. The programmable controller 100 may be routinely provided some basic well bore geometry information, such as hole size, depth, tubular sizes, lengths and taper configurations. Tubular OD and ID data may also be provided. Mud pump plunger size, stroke length, push-rod size, and pump type, e.g., duplex, triplex, quintiplex, double-acting, single-acting, each may be routinely provided the control system 100. Mud weight, viscosity, gel strength, pit volume may be provided the control system. Any routine provision to or obtaining by the control system 100 of such information may be performed at selected intervals, such as each time a joint of drill pipe is added to the drill string, once each crew-change, or once each day. Updating of information may be dependent at least partially upon the drilling related activity being undertaken and the present well, geological and environmental conditions. The selected intervals may be automatically executed and/or may be executed in response to a manual instruction to perform such updating.

The control system 100 may be programmed to routinely establish a benchmark well bore circulating pressures, automatically and/or by manual instruction. For example, once each eight hour tour, the control system may prompt for an instruction to proceed with automatically establishing benchmark circulating pressures. Upon receiving such authorization, the controller 100 may cause drilling operation to be temporarily interrupted, the bit picked up off bottom of the well bore and the mud pump 90 caused to pump drilling mud at one or more of pre-selected pump flow rates. At each selected pump flow rate, a corresponding drill pipe first fluid circulating pressure may be sensed and recorded by the programmable controller 100. The drilling fluid may be circulated through the drill string 50, through the drill bit 56, through the well bore annulus 30 and separately through the choke line 32. The circulating pressure and rate information may then be utilized by the controller 100 to determine a circulating drill pipe pressure for a variable range of circulating rates. In order to improve accuracy of the determined circulating pressures, the measured rates and pressures may be sensed and recorded at pump rates representative of a useable range of rates. The fluid circulated during determination of the benchnmark circulating pressures and rates may be the first fluid, and may include a first density. The controller 100 may also execute a known procedure to execute a casing seat/fracture gradient test to determine an upper limit for hydrostatic pressure within the well bore 30.

In response to a sensed warning sign that a kick or other hydrostatic pressure control concern may be present in the well bore 30, the controller may warn, prompt for an instruction/direction, and/or automatically execute shut-in procedures. The particular shut-in procedure to be executed may be determined or selected automatically by the controller, dependent at least partially upon the type of drilling rig 25 in use and the drilling operation being performed when the kick is detected. For example, an immobile rig may follow a different shutin procedure from a floating rig, and a different procedure may be executed when drilling as compared to when tripping the drill string. If a shallow blow-out is encountered, a diverter procedure may be executed.

The controller 100 may execute the selected shut-in procedure. To shut-in a well bore, typically, a BOP 10, 12, 14, 16, may be closed on the drill string 50, and the choke 70 may be closed, and the mud pump 90 may stop mud circulation. Shut-in pressures may be sensed in each of the drill string 50 and the well bore annulus 30, by pressure sensors 82 and 84, respectively. The controller 100 may then calculate or determine a kick pressure in the well bore, such as the sum of the shut-in drill pipe pressure plus the hydrostatic pressure. The kick pressure may be maintained as a substantially constant bottom hole pressure by the controller 100 while circulating the kick out of the well bore 30 and while circulating a second fluid, a kill weight fluid, into the well bore 30. Those skilled in the art may recognize that in certain circumstances, such as where a kick may be induced into a well bore, such as by improper fill-up during tripping, or by swabbing, the second fluid may be substantially the same fluid as the first fluid. In drill string installations including a float valve which may prevent the direct interpretation of the kick/bottom hole pressure by a drill string pressure sensor 82, the controller 100 may execute a known procedure to determine the kick pressure through the drill string, such as by pumping slowly into the drill string 50.

The controller 100 also may be capable of removing the kick fluid substantially without a shut-in period to obtain data. For example, when a kick is suspected, the controller may circulate out the kick using the Driller's method with drill string friction data collected previously when the kick was assumed to not be in the well, such as during the previous drill pipe stand connection or disconnection. After removal of the kick fluid, the controller may temporarily cease pump circulation, collect appropriate pressure data, and then continue pumping using the Engineer's method with weighted-up mud, if desired. An advantage of such technique may be elimination of further kick influx during the initial shut-in period, such as may be experienced under prior practices. A disadvantage of not having the initial shut-in drill pipe pressure may be less confidence in the determination of influx formation pressure. However, increased safety by using the controller and the ability of the controller and sensors to readily and rapidly implement changes in wellbore hydrostatic pressure profiles may make the techniques of this invention a safer, more reliable approach.

The controller 100 also may be manually directed or may automatically execute a known, routine to check trapped pressure within the well bore 30, and to bleed any trapped pressure from the well bore 30. Bleeding trapped pressure from within the well bore may facilitate a more accurate determination of a shut-in drill pipe pressure and a shut-in casing pressure. Thereby, the controller may make more accurate calculations and determinations and may enhance the accuracy of calculations and may make killing the well easier. Trapped pressure may be automatically sensed within and controllably bled from the well bore annulus by the controller 100.

The controller 100 may determine an influx gradient for the kick fluid that entered the well bore 30. The controller may also determine the weight/density required of the second fluid, e.g., the kill fluid, to kill the well or regain hydrostatic control. Thereafter, the controller 100 may execute a known kill/circulation procedure. Such kill/circulation procedures may include the one-circulation/engineer's method, the two circulation/driller's method or the concurrent method where pumping may begin immediately after sensing and recording the shut-in pressures, while the density is increased as the kick is pumped out of the well bore 30. The controller 100 may control the mud pump 90 to pump the second/kill fluid into the drill string 50 at a selected kill flow rate and a circulating drill pipe kill pressure, then through the drill string, then through the annulus of the well bore and then substantially back to the drilling rig. While pumping the second/kill fluid, the circulating drill pipe kill pressure may follow a pressure schedule determined by the controller 100. While performing the kill/circulation procedure, the controller may maintain a substantially constant bottom hole/kill pressure on the formation, by regulating the choke 71.

The programmable controller 100 may control pumping the second fluid at the selected kill flow rate, as well as the percentage of which the drilling fluid choke is opened, relative to being fully closed and fully opened, such that while pumping the second/kill fluid the bottom hole/kill circulating fluid pressure remains substantially constant and at least as great as the bottom hole kick pressure. The controller 100 may also ensure that the bottom hole circulating fluid pressure does not exceed a formation fracture pressure, either calculated, estimated or determined previously by the controller.

Unlike traditional kill methods which may be performed as a substantially constant selected kill flow rate, the controller may maintain a substantially constant bottom hole/kill pressure while responding to variations in the selected kill flow rate while pumping either the first and/or second/kill fluid. In response to changes in the selected kill flow rate, the controller 100 may recalculate or adjust the pumping schedule for the remainder of the pumping procedure, such that a constant bottom hole pressure is maintained. To maintain a substantially constant bottom hole pressure, the controller may adjust the choke 70 in response to the kill flow rate changes and in response to pressure changes encountered upstream of the choke during execution of the circulation/kill procedure. The controller 100 may determine the volume of fluid pumped in response to one or more sensors, such as a stroke counter 95 on the pump 90, a flow meter 94, or a change in fluid level within an indexed vessel such as a kill tank.

The controller 100 may further include an operator control assembly 104, 106, 108, such as a control console with control components for selectively adjusting the programmable controller 100 and/or regulated components, such as the choke 70 and/or the mud pump 90, during the procedure. An operator controller 104 may be included for making operational changes, such as pump rate changes, during execution of a control procedure that may be controlled by the controller 100. A controller programmer 106 may also be included to facilitate altering the programming of the controller 100, such as switching from the "driller's method" to the "engineer's method," or inputting a revised drill string 50 dimensional value, such as the length of a segment of the drill string 50. A data introducer 108, such as a key-board, may be included to facilitate inputting data into the programmable controller 100. The data introducer and/or the operator controller may be comprised of known data input components, such as a key-board, a joy-stick, buttons, switches or other manipulative devices, and/or electronic signals.

The controller 100 may also include a display 102, such as a video screen, LED readout, and/or a printed record of parameters, to facilitate visually monitoring pressures, calculated parameters, and progress of the circulation/kill procedure, as a function of time or another variable. The display 102 may also provide graphical, animated, tabulated, and/or charted representations of parameters and/or conditions during a procedure to an operator and/or another control system, such as an automatic driller. Such graphical representations may include the predicted/scheduled pressures, rates and volumes may be presented. Information displayed may include one or more of (a) the circulating drill pipe kill pressure, (b) the annulus fluid pressure, (c) the bottom hole kick pressure, (d) the bottom hole circulating fluid pressure, (e) the selected kill flow rate, and (f) a volume of fluid pumped.

Displayed information also may be presented on a video screen and/or a paper printout. An graphical diagram including a representative well bore illustration may be displayed, by which to illustrate progression of the procedure and to display procedure parameters, each in substantially real time. Such presentation may be animated and/or periodically updated during the procedure. The controller 100 may also be integrated into an automatic drill system, whereby various components comprising the drilling rig 25, such as the draw-works, rotary table, and/or a top drive, may be at least partially controlled by the programmable controller 100. The programmable controller may control an axial position of the drill string 50 relative to the well bore 30. For example, when a kick is sensed, the programmable controller 100 may cause the draw-works to pull the drill string 50 up the well bore 30 for a distance such that the rams may be closed without closing the BOP rams on a joint in the drill string 50.

In the event the drill string 50 may need to be stripped into or out of the well bore 30, the programmable controller 100 may control the opened/closed position of the BOPs in coordination with movement/positions of the drill string as drill string pipe joints pass through the BOPs. The controller 100 may control the stripping procedure in accord with known methods for stripping pipe, such as the "volumetric method" and the "dynamic method." The controller 100 may also control filling the well bore 30 with mud as the drill string 50 is tripped or stripped out of the well bore 30.

Each of the well bore annulus pressure sensor 84 and the drill pipe pressure sensor 80 may include one or more additional respective sensors to provide a second measurement or sensing of the respective pressure being sensed. Thereby, a measure of the reliability and quality of the sensed data may be made by the controller. Priorities may be assigned to respective sensors and programmed into the controller 100 such that the when data reliability may be questionable, the controller 100 may respond accordingly, such as by shutting down the kill operation until an operator instructs the controller on proceeding, or the controller 100 may provide a warning that sensor inconsistencies may be present. Those skilled in the art will appreciate that certain sensors may be more reliable than others, in certain situations and the controller 100 may be provided with algorithms and routines to accommodate components of a particular installation in a desired fashion.

The methods and systems of this invention are not limited to drilling installations and drilling rigs. The methods and systems of this invention may be utilized in a work-over operation, when running casing, tripping a string of pipe into or out of a well bore, when conducting completion operations, or in specialized well control operations. Equipment used may also include conventional and known non-conventional equipment, including coiled tubing units or snubbing units.

The programmable controller 100 may regulate controlled components of the rig, either electrically, mechanically, hydraulically and/or pneumatically. In addition, some rig 25 components may be operated by the control system, while still other components may be substantially simultaneously operated manually. In some embodiments, certain components such as the choke 70, the BOPs 10, 12, 14, 16, and the mud pump 90, may be selectively operated manually and/or by the programmable controller 100.

It is a feature of this invention to intentionally use any of a wide continuum of circulation rates during the circulation, and not be limited to pre-determined, discrete rates, such as 20, 30, 40 strokes per minute. With the techniques of this invention, a choice of circulation rate or a variation of the circulation rate may be made at substantially any time during the kill operation, either manually by the operator, automatically by the control system, and/or both.

The control system 100 may use known statistical process control ("SPC") techniques to continually determine that the control system 100 is truly "in control." A programmable controller may execute programmed control procedures, at least partially by using SPC techniques comparing "set-point" or reference values to corresponding measured or determined values. For example, set-point values may be pre-determined, either by measurement, calculation or by operator entry, and entered into the controller for selected variables such as measured bottom hole pressure, computed bottom hole pressure, pump rate, drill pipe pressure and subsea BOP pressure on floating rigs.

An SPC technique may include sensing each of a first fluid pressure with a first fluid pressure sensor and a second fluid pressure substantially simultaneously with a second fluid pressure sensor, both at a common point in the fluid system, such as the drill string or the well bore annulus. The programmable controller may be used to selectively compare the first sensed fluid pressure with the second sensed fluid pressure to calculate a sensed pressure deviation or differential between the two sensors. The sensed pressure deviation may be compared to a predetermined reference pressure deviation, and an alarm signal may be generated when the sensed pressure deviation is greater than the predetermined reference pressure deviation. Thereby, when redundant pressure sensors at a common point do not measure within a predetermined range of agreement, an operator may be alerted that a sensor may be failing or providing erroneous data. Although pressure is the SPC variable used in this illustration, SPC techniques may be applied to any sensed value or variable in the fluid system, including pump stroke rate, pit levels, gas detection, mud return line flow rate, and mud weight.

The SPC reference value/set point may be obtained and/or provided from another measurement, such as a prior measurement of the subject sensors or provided to the controller by one or more other sensors. The reference value/set point may be obtained and/or provided by calculation, programming algorithms, sensor measurement, a predetermined value, or a value entered by an operator.

A potential benefit of using of SPC may be identifying difficult-to-detect downhole problems at an early developmental stage. Examples of such problems may include lost circulation; washouts in the drill string, bottom hole assembly and/ the drill bit; and plugging of bit nozzles or in the drill string. The ability to identify hydrostatic complications early also may stem from an observation that, if all surface equipment and control systems are functioning properly and the system is not "in-control," then some other, not-directly measurable factor, such as a down-hole hydrostatic pressure problem, may be a likely cause of the "out-of-control" situation. Surface equipment problems, such as a choke washout, may also be detectable by the SPC approach. The control system may provide a suite of alarms specific to the well control plan selected, including the following:

"Loss of control" on any controlled parameter;

Inability of a mud-gas separation system to safely function, as indicated by excessive vessel pressure and/or excessive high or low liquid level therein;

Excessive pressure at any point within the system, including annulus, piping, choke manifold and flare line.

Sensor failure.

Choke control command and operation; and

Temperature and/or pressure conditions at a choke, subsea BOP or elsewhere in the circulation system indicating possible formation of hydrates.

If an operator is manually controlling the pumping and/or control system and an alarm (such as from the above list) occurs, then instead of the operator reacting by manually reducing the circulation rate, the operator may engage the control system to take over such rate reduction and to automatically control the circulation/kill procedure and/or provide the operator with the control targets specific to the new circulation rate.

When the control system is in control and an alarm (such as from the above list) occurs, the control system may automatically reduce the circulation rate and adjust the control parameters automatically. Conversely, if the control system reduced the circulation rate in response to the alarm, and when the alarm condition is cleared up, the control system may increase the circulation rate automatically to a desired or determined rate. Such SPC-automatic operation strategy may allow the control system to safely and accurately circulate out a kick in a reduced amount of time and within operating limits set by the operator, such as maximum pump rate.

An operator may also interact with the control system to manually controlling only pump rate and having the control system operate the choke. In the event an alarm condition is sensed, the operator may elect to continue manual control of the pump or may allow the control system to take over pump control.

The operator also may program the control system 100 to use any of the current well control techniques, such as the Driller's method and/or the Engineer's method, in manual and/or automatic mode of control. For example, the operator may plan to circulate a kick out of the wellbore at one circulation rate, which the control system may execute. However, if during execution any complications are detected by the operator or the control system, then the control system may reduce the circulation rate to a rate safe for the conditions. The control system may also be programmed to not increase the automatic pump rate above the original operator-specified set-point pump rate.

The control system 100 may be programmed to detect sensor failures, or erroneous data. For example, duplicate sensors may be provided at each sensed location. SPC monitoring of the sensor outputs may be performed by the control system to determine when an output reading varies statistically significant from a reading of the duplicate sensor.

When in automatic mode, the control system 100 may provide an operator a sufficiently detailed control plan and schedule such that the operator may manually execute the plan in the event of a sensor or control device failure, or failure of the control system to operate. Such plan may thereby be utilized as a backup plan, or as a primary control plan, and may be updated regularly during drilling operations. The plan may be retrievable from a plan storage area, either in hard printout form or electronically, on demand. The control plan may also include consideration of a wide variety of sensors. For example, target drill pipe pressure may be defined for one or more electronic pressure sensors and for one or more hydraulic gauges. The appropriate relationships between these sensed values may be determined by the system.

In the event that well control is not regained by reducing the circulation rate, or by executing one or more well control procedures, or if the quality of data provided the controller is questionable or erroneous, the controller 100 may be provided capability to implement an Emergency Shut Down (ESD) of the well, the drilling equipment and/or the pumping equipment. An ESD procedure may include automatic operation of one or more components of equipment and/or providing the operator with guidance on manual actions.

The controller 100 may also operate secondary supporting equipment as part of the control scheme. For example, in the event of excessive gas-mud separator pressure, the controller may shut-in the well and open a "blow-down line" to reduce the pressure.

It may be appreciated that various changes to the details of the illustrated embodiments and systems disclosed herein, may be made without departing from the spirit of the invention. While preferred and alternative embodiments of the present invention have been described and illustrated in detail, it is apparent that still further modifications and adaptations of the preferred and alternative embodiments will occur to those skilled in the art. However, it is to be expressly understood that such modifications and adaptations are within the spirit and scope of the present invention, which is set forth in the following claims.

I claim:

1. A system for maintaining fluid pressure control of a well bore drilled through a subterranean formation using a drilling rig and a drill string having a through bore and positioned at least partially within the well bore, the system comprising:

a BOP to contain an annulus fluid pressure within an annulus of the well bore;

a drilling fluid choke in fluid communication with the annulus of the well bore;

a fluid pump for pumping the selected fluid at a benchmark selected fluid circulation rate through the drill string, then through the annulus of the well bore and substantially back to the drilling rig;

a drill pipe pressure sensor to sense a fluid pressure within the drill string; and a programmable controller responsive to the drill pipe pressure sensor to control at least one of (a) the fluid pump to effect the fluid circulation rate, (b) the drilling fluid choke to control pressure in the annulus of the well bore, and (c) the BOP to control pressure in the annulus of the well bore, such that while pumping the selected fluid a bottom hole circulating fluid pressure remains substantially constant and at least as great as the bottom hole kick pressure, while also controlling an axial position of the drill string relative to the well bore.

2. The system for maintaining fluid pressure control of a well bore as defined in claim 1, further comprising:

a display for displaying as a function of time, one or more of (a) the circulating drill pipe kill pressure, (b) the annulus fluid pressure, (c) the bottom hole kick pressure, (d) the bottom hole circulating fluid pressure, (e) the selected kill flow rate, and (f) a volume of fluid pumped.

3. The system for maintaining fluid pressure control of a well bore as defined in claim 1, further comprising:

a well bore annulus pressure sensor to sense a fluid pressure in the annulus of the well bore.

4. The system for maintaining fluid pressure control of a well bore as defined in claim 1, further comprising:

an operator controller to override the programmable controller.

5. The system for maintaining fluid pressure control of a well bore as defined in claim 1, further comprising:

a controller programmer to alter the programmable controller.

6. The system for maintaining fluid pressure control of a well bore as defined in claim 1, further comprising:

a data introducer to input data into the programmable controller.

7. The system for maintaining fluid pressure control of a well bore as defined in claim 1, wherein the programmable controller further controls a draw-works to control the axial position of the drill string relative to the well bore.

8. A system for maintaining fluid pressure control of a well bore drilled through a subterranean formation using a drilling rig and a drill string having a through bore and positioned at least partially within the well bore, the system comprising:

a BOP to contain an annulus fluid pressure within an annulus of the well bore;

a drilling fluid choke in fluid communication with the annulus of the well bore;

a fluid pump for pumping the selected fluid at a benchmark selected fluid circulation rate through the drill string, then through the annulus of the well bore and substantially back to the drilling rig;

a drill pipe pressure sensor to sense a fluid pressure within the drill string;

a programmable controller responsive to the drill pipe pressure sensor to control at least one of (a) the fluid pump to effect the fluid circulation rate, (b) the drilling fluid choke to control pressure in the annulus of the well bore, and (c) the BOP to control pressure in the annulus of the well bore, such that while pumping the selected fluid a bottom hole circulating fluid pressure remains substantially constant and at least as great as the bottom hole kick pressure; and a controller programmer to alter the programmable controller.

9. The system for maintaining fluid pressure control of a well bore as defined in claim 8, further comprising:

a display for displaying as a function of time, one or more of (a) the circulating drill pipe kill pressure, (b) the annulus fluid pressure, (c) the bottom hole kick pressure, (d) the bottom hole circulating fluid pressure, (e) the selected kill flow rate, and (f) a volume of fluid pumped.

10. The system for maintaining fluid pressure control of a well bore as defined in claim 8, further comprising:

a well bore annulus pressure sensor to sense a fluid pressure in the annulus of the well bore.

11. The system for maintaining fluid pressure control of a well bore as defined in claim 8, further comprising:

an operator controller to override the programmable controller.

12. The system for maintaining fluid pressure control of a well bore as defined in claim 8, further comprising:

a data introducer to input data into the programmable controller.

13. The system for maintaining fluid pressure control of a well bore as defined in claim 8, wherein the programmable controller further controls one or more of the draw-works and an axial position of the drill string relative to the well bore.

14. A method of maintaining fluid pressure control of a well bore drilled through a subterranean formation using a drilling rig and a drill string having a through bore and positioned at least partially within the well bore, the method comprising:

providing a BOP to contain an annulus fluid pressure within an annulus of the well bore;

providing a drilling fluid choke in fluid communication with the annulus of the well bore;

providing a fluid pump for pumping the selected fluid at a benchmark selected fluid circulation rate through the drill string, then through the annulus of the well bore and substantially back to the drilling rig;

sensing a fluid pressure within the drill string; and in response to the sensed drill pipe fluid pressure, automatically controlling at least one of (a) the fluid pumps to effect the fluid circulation rate, (b) the drilling fluid choke to control pressure in the annulus of the well bore, and (c) the BOP to control pressure in the annulus of the well bore, such that while pumping the selected fluid a bottom hole circulating fluid pressure remains substantially constant and at least as great as the bottom hole kick pressure, while also automatically controlling an axial position of the drill string relative to the well bore.

15. The method as defined in claim 14, further comprising:

inputting data into the programmable controller.

16. The method as defined in claim 14, wherein the programmable controller further controls a draw works to control the axial position of the drill string relative to the well bore.

17. The method as defined in claim 14, further comprising:

variably adjusting a kill flow rate while substantially simultaneously controlling the drilling fluid choke to maintain the substantially constant bottom hole circulating fluid pressure.

18. The method as defined in claim 14, further comprising:

sensing fluid pressure in the annulus of the well bore substantially upstream of the drilling fluid choke.

19. The method as defined in claim 14, further comprising:

displaying, as a function fo time, one or more of (a) the circulating drill pipe kill pressure, (b) the annulus fluid pressure, (c) the bottom hole kick pressure, (d) the bottom hole circulating fluid pressure, (e) the selected kill flow rate, and (f) a volume of fluid pumped.

20. The method as defined in claim 14, further comprising:

sensing a first fluid pressure in at least one of the drill string and the well bore annulus;

sensing a second fluid pressure in at least one of the drill string and the well bore annulus;

using the programmable controller to selectively compare the first sensed fluid pressure with the second sensed fluid pressure to calculate a sensed pressure deviation;

comparing the sensed pressure deviation to a predetermined reference pressure deviation; and generating an alarm signal when the sensed pressure deviation is greater than the predetermined reference pressure deviation.

* * * * *